US005377822A

United States Patent [19]

Herzog

[11] Patent Number: 5,377,822

[45] Date of Patent: Jan. 3, 1995

[54] PACKAGE FOR SUPPORTING AND DISPLAYING A STRAP-TYPE WRISTWATCH

[76] Inventor: Jack L. Herzog, 5702 Durocher Street, Montreal, Canada, H2V 3Y2

[21] Appl. No.: 91,251

[22] Filed: Jul. 14, 1993

[51] Int. Cl.[6] ..... B65D 85/40

[52] U.S. Cl. ..... 206/45.14; 206/6.1; 206/301

[58] Field of Search ..... 206/6.1, 566, 301, 18, 206/70, 45.14

[56] References Cited

U.S. PATENT DOCUMENTS

| | | | |
|---|---|---|---|
| 1,909,020 | 5/1933 | Shields | 206/301 X |
| 4,082,183 | 4/1978 | Sturm | 206/301 |
| 4,094,409 | 6/1978 | Spranger et al. | 206/301 X |
| 4,830,181 | 5/1989 | Hartman | 206/301 X |
| 5,181,608 | 1/1993 | Herzog | 206/301 |

*Primary Examiner*—Paul T. Sewell
*Assistant Examiner*—Jacob K. Ackun, Jr.
*Attorney, Agent, or Firm*—Pollock, VandeSande and Priddy

[57] ABSTRACT

A package for supporting and displaying a strap-type wristwatch without requiring that the straps be buckled together comprises an elongated wristwatch support member having slots formed adjacent its opposing ends. The straps of a wristwatch can be slipped into the slots to retain the wristwatch on the support member without buckling the straps together.

5 Claims, 2 Drawing Sheets

PACKAGE FOR SUPPORTING AND DISPLAYING A STRAP-TYPE WRISTWATCH

BACKGROUND OF THE INVENTION

The present invention relates to packages or boxes for wristwatches, and is more particularly concerned with wristwatch support members that can be used in such packages to support and display a strap-type wristwatch without requiring that the straps of the watch be buckled together.

Herzog U.S. Pat. No. 5,181,608 issued Jan. 26, 1993, for "Package for Supporting an Unbuckled Strap-Type Wristwatch" discloses a package that includes a substantially C-shaped wristwatch support element having a pair of integral clips disposed adjacent opposite end portions of the support element. A strap-type wristwatch is mounted on the support element by slipping the straps of the watch into the clips to retain and support the wristwatch in place without buckling the straps together.

The patented Herzog package eliminates a number of disadvantages, described in the patent, inherent in strap type wristwatch support packages used prior to the Herzog invention. The present invention constitutes an improvement on the patented Herzog package which achieves those same advantages, but which does so by use of a modified wristwatch support element that is less expensive to manufacture, is even easier to mount and dismount a watchband, and which can be used with all watchbands irrespective of their thickness in contrast to the patented Herzog package wherein the space provided between each clip and the underlying support element limited the thickness of the watchband that could be retained in place by the clip.

SUMMARY OF THE INVENTION

As in the package of the aforementioned Herzog '608 patent, the disclosure of which is incorporated herein by reference, the wristwatch support and display package of the present invention includes a substantially C-shaped element having an elongated central segment terminating in opposite end portions that are positionally displaced from said central segment. In the present invention, at least one slot is formed in each of the end portions of the C-shaped element, each slot opening into and extending from an edge of its associated end portion partially across that end portion in a direction transverse to the direction of elongation of the central segment of the support element. The length of each slot is greater than the width of a watchband to be supported in the package, and the width of each slot is greater than the strap thickness of any watchband that is likely to be supported in the package. With such an arrangement, a strap-type wristwatch can be held in position on the wristwatch support member by the simple expedient of slipping the straps into the slots at the opposing ends of the wristwatch support member.

In variant forms of the invention, more than one slot can be provided adjacent one or both ends of the substantially C-shaped element. Where, for example, two slots are formed in spaced relation to one another in one of the end portions of the wristwatch support element, both slots extend partially across that end portion from the same edge of the end portion.

Moreover, while the slots alone may be relied upon to support a wristwatch in place, the wristwatch support member may be provided with one or more overlying clips of the type disclosed in the Herzog '608 patent, in addition to the slots. Where such clips are provided, they are spaced from the slots in the direction of elongation of the central segment of the C-shaped support element, and each clip extends across the support element from an edge of the support element opposite to the edge into which the slots open.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Each of the embodiments of the present invention utilizes a generally C-shaped support member that incorporates slots used to retain in place the straps of a strap-type wristwatch. The C-shaped member includes, in each case, an elongated substantially flat central segment that merges at opposing ends into a pair of end portions that are positionally displaced from the central segment. As disclosed in the Herzog '608 patent, the end portions may each be curved, may exhibit the same or different curvatures, may exhibit curvatures of different or like extents, and may in some cases take the form of end portions that are displaced with little if any curvature and with the same or different extents. All of these various arrangements, and others which will be apparent to those skilled in the art, are considered to be "C-shaped" support members that can be used in the present invention.

Figure 1:
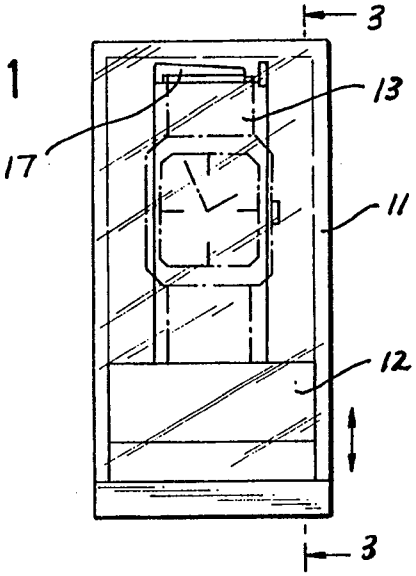
FIG. 1 is a front view of a package constructed in accordance with a first embodiment of the invention.
Figure 2:
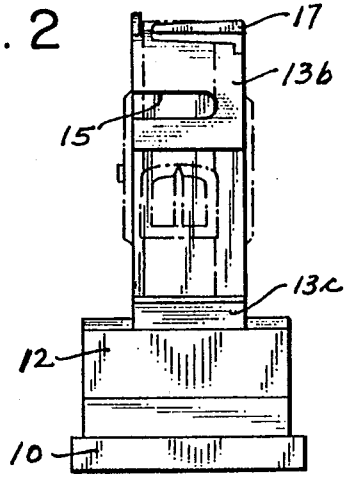
FIG. 2 is a rear view of the package shown in FIG. 1 with the cover removed.
Figure 3:
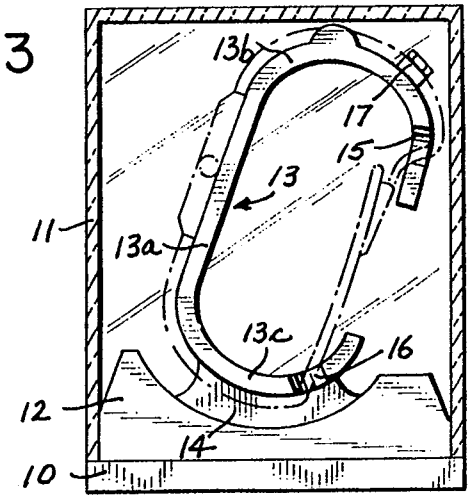
FIG. 3 is a side view of the FIG. 1 package taken on the line 3—3 of FIG. 1.

FIGS. 1–3 disclose a first embodiment of the present invention wherein the package comprises a base 10 that is adapted to receive a box-like cover 11 fabricated, for example, of a transparent plastic material that permits the contents of the package to be viewed while the cover 11 is seated on the base 10. The base 10 is integrated with a wristwatch support member 12 that includes a generally C-shaped support element 13 having an elongated central segment 13*a* merging at its opposing ends into a pair of end portions 13*b* and 13*c*. The C-shaped element 13 is integrated with base 10, and more particularly with member 12, by a web 14 that extends between member 12 and one side of end portion 13*c*. Base 10, support member 12, the C-shaped support element 13 and web 14 may comprise different integral portions of a plastic member molded as a single unit. This same unitary plastic molding approach may be employed, moreover, in each of the other embodiments of the present invention to be described hereinafter.

A slot 15 is provided in end portion 13*b*, and a similar slot 16 is provided in end portion 13*c*, into which the opposing straps of a strap-type wristwatch can be slipped to retain the wristwatch on the support member without buckling the straps together. Each slot 15, 16 opens into an edge of its associated end portion, extends partially across the end portion toward the other edge, and terminates in a smoothly curved interior end. The length of each slot is at least equal to, and preferably slightly greater than, the width of the watchband that is to be inserted into the slots, and the width of each slot is greater than the maximum thickness of the strap of any wristwatch band contemplated to be supported in the package. In an actual embodiment of the invention, the width of the support member 12 and its associated end portions 13*b*, 13*c* is approximately 0.875 inches, the length of each slot is substantially 0.625 inches, and the width of each slot is substantially 0.23 inches.

In the particular embodiment shown in FIGS. 1–3, end portion 13*b* of the support element is provided with a flexible clip 17, of the type disclosed in the Herzog '608 patent, in addition to the slot 15 provided in said end portion. Clip 17 is located between slot 15 and central segment 13*a* of the support element, and extends in overlying relation to end portion 13*b* from an edge of the support element opposite the edge into which slot 15 opens. With such an arrangement, and as shown in each of FIGS. 1–3, a watch is supported in place by slipping one of its straps through clip 17 and then through slot 15 to the interior of the support element, while the other strap is slipped through lower slot 16 to the interior of the support element. The opposing ends of the slots may, as shown in FIG. 3, be disposed in overlying relation to one another when the watch is so mounted in place, but the straps need not be buckled together to retain the watch in position on the support member.

Figure 4:
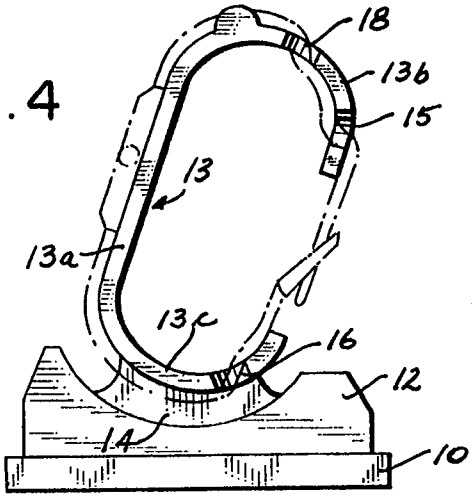
FIG. 4 is a side view of a wristwatch support element constructed in accordance with a second embodiment of the invention.
Figure 5:
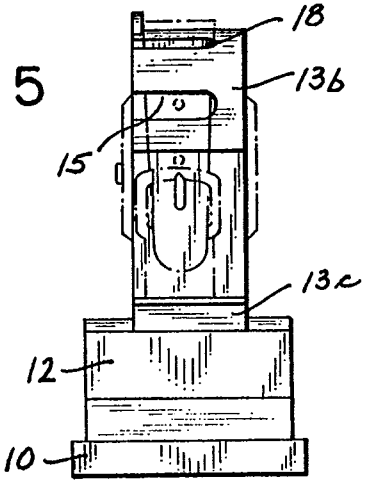
FIG. 5 is a rear end view of the support element shown in FIG. 4.

A second embodiment of the invention is shown in FIGS. 4 and 5. Elements which correspond to those already described with reference to FIGS. 1–3 are given like numerals in FIGS. 4 and 5. In this second embodiment of the invention, the clip 17 is not provided and, instead, a second slot 18, having dimensions substantially the same as those of slots 15 and 16, is provided in upper end portion 13*b* between slot 15 and central segment 13*a* of the support member. With an arrangement of this type, as best shown in FIG. 4, a wristwatch is supported in place by slipping the upper strap through slot 18 and then through slot 15, while the lower strap is slipped through slot 16. Although FIG. 4 depicts in broken lines that the free end of the upper strap can be slipped into the buckle of the lower strap, the straps need not be physically buckled together to retain the watch in place.

Figure 7:
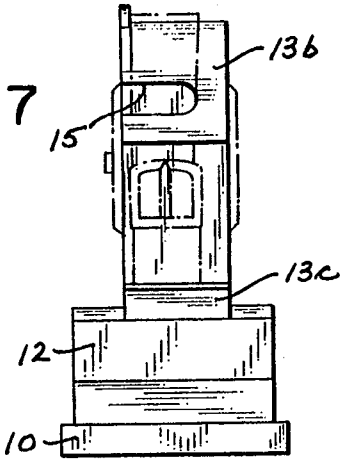
FIG. 7 is a rear end view of the FIG. 6 support element.
Figure 6:
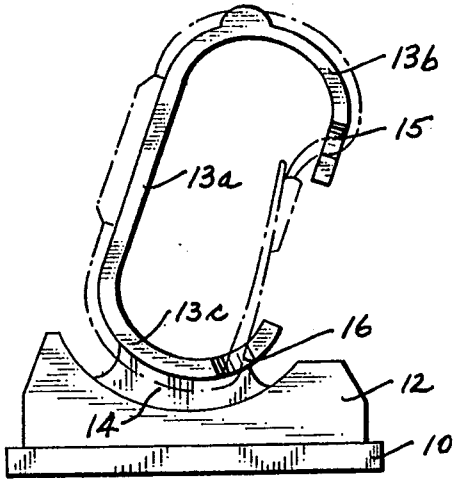
FIG. 6 is a side view of a support element constructed in accordance with a third embodiment of the invention.

A third embodiment of the invention is shown in FIGS. 6 and 7. This particular embodiment of the invention is the same as that described with reference to FIGS. 1–3, except that in the third embodiment of the invention no clip 17 is provided. Instead, the strap retaining means provided in the C-shaped element takes the form of a single slot 15 in end portion 13*b* and a single slot 16 in end portion 13*c*.

Figure 9:
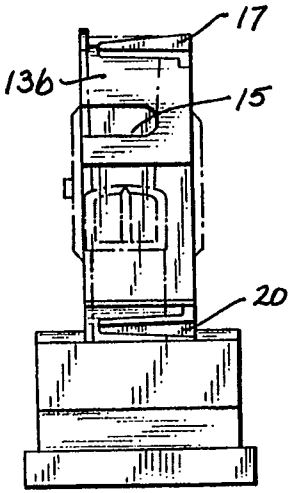
FIG. 9 is a rear end view of the FIG. 8 support element.
Figure 8:
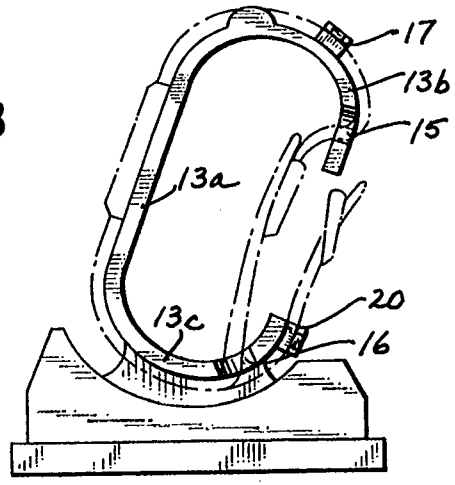
FIG. 8 is a side view of a support element constructed in accordance with a fourth embodiment of the invention.

The fourth embodiment of the invention shown in FIGS. 8 and 9 is also the same as the first embodiment shown in FIGS. 1–3, except that, in addition to the flexible clip 17 provided in upper end portion 13*b*, a further flexible clip 20 of similar construction is provided in lower end portion 13*c*. The additional clip 20 is located between slot 16 and the free end of end portion 13*c*, preferably at said free end, in contrast to clip 17 which is located between slot 15 and central segment 13*a* of the support element. Each of clips 17 and 20 are integral with the support element adjacent an edge of the support element opposite to the edge into which the slots 15 and 16 open, and extend in overlying relation to the support element in generally parallel relation to one another as shown in FIG. 9.

Having thus described my invention I claim:

1. In a package for supporting and displaying a strap-type wristwatch that has a pair of straps, adapted to be buckled together when worn on the wrist of a user, without requiring that said straps be buckled together for purposes of such support and display in the package, said package including a support member that comprises a substantially C-shaped element having an elongated central segment terminating in opposite end portions that are positionally displaced from said central segment, and strap retaining means integral with said supporting member, the improvement wherein said central segment is free of means for retaining a wristwatch in place on said support member, said strap retaining means including at least two slots, one in each of said end portions, extending transverse to the direction of elongation of said central segment, each of said slots opening into an edge of its associated end portion, said slots being provided to hold a strap-type wristwatch in place on said support member by slipping the two straps of a wristwatch into said two slots respectively, at least one of said end portions also including a flexible clip positioned in overlying relation to said end portion, said clip being integral with a second edge of said one end portion opposite the edge into which the slot in said one end portion opens, said clip extending from said second edge across said one end portion in spaced substantially parallel relation to the slot in said one end portion.

2. The package of claim 1 wherein an interior end of each said slot has a smoothly curved configuration.

3. The package of claim 1 wherein at least one of said end portions includes a pair of said slots disposed in spaced relation to one another.

4. The package of claim 3 wherein both of said slots open into the same edge of said one end portion.

5. The package of claim 1 wherein both of said slots extend partially across said associated end portions from the same edge of said end portions.

* * * * *